US007082665B2

(12) United States Patent
Deshmukh et al.

(10) Patent No.: US 7,082,665 B2
(45) Date of Patent: Aug. 1, 2006

(54) METHOD FOR PROCESSING A GOLF CLUB HEAD WITH CUP SHAPED FACE COMPONENT

(75) Inventors: Uday V. Deshmukh, Carlsbad, CA (US); Herbert Reyes, Laguna Niguel, CA (US)

(73) Assignee: Callaway Golf Company, Carlsbad, CA (US)

( * ) Notice: Subject to any disclaimer, the term of this patent is extended or adjusted under 35 U.S.C. 154(b) by 212 days.

(21) Appl. No.: 10/710,143

(22) Filed: Jun. 22, 2004

(65) Prior Publication Data

US 2005/0278931 A1 Dec. 22, 2005

(51) Int. Cl.
*B21D 1/46* (2006.01)
*B23P 21/00* (2006.01)

(52) U.S. Cl. ..... 29/527.6; 29/527.5; 29/469

(58) Field of Classification Search ..... 29/469, 29/428, 527.1, 525, 505, 509, 513, 525.14; 425/398; 264/325; 156/242
See application file for complete search history.

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |
| 2,750,194 | A | 6/1956 | Clark |
| 3,692,306 | A | 9/1972 | Glover |
| 3,897,066 | A | 7/1975 | Belmont |
| 3,937,474 | A | 2/1976 | Jepson et al. |
| 3,970,236 | A | 7/1976 | Rogers |
| 3,975,023 | A | 8/1976 | Inamori |
| 3,989,248 | A | 11/1976 | Campau |
| 4,021,047 | A | 5/1977 | Mader |
| 4,398,965 | A | 8/1983 | Campau |
| 4,568,088 | A | 2/1986 | Kurahashi |
| 4,687,205 | A | 8/1987 | Tominaga et al. |
| 4,872,685 | A | 10/1989 | Sun |
| 4,877,249 | A | 10/1989 | Thompson |
| 5,024,437 | A | 6/1991 | Anderson |
| 5,094,383 | A | 3/1992 | Anderson |
| 5,106,094 | A | 4/1992 | Desbiolles et al. |
| 5,172,913 | A | 12/1992 | Bouquet |
| 5,193,811 | A | 3/1993 | Okumoto et al. |
| 5,255,918 | A | 10/1993 | Anderson |
| 5,261,663 | A | 11/1993 | Anderson |
| 5,261,664 | A | 11/1993 | Anderson |
| 5,272,802 | A | 12/1993 | Stites, III |
| 5,282,624 | A | 2/1994 | Viste |
| 5,310,185 | A | 5/1994 | Viollaz et al. |
| 5,344,140 | A | 9/1994 | Anderson |
| 5,346,216 | A | 9/1994 | Aizawa |

(Continued)

*Primary Examiner*—John C. Hong
(74) *Attorney, Agent, or Firm*—Michael A. Catania; Elaine H. Lo

(57) ABSTRACT

A method for producing a golf club head (42) with a two-piece face component (60) and an aft-body (61) is disclosed herein. The face component (60) includes a formed or forged striking face insert (72) and a cast face cup (74) with a front face (81) and a return portion (77) and separately forming the striking face insert (72). The striking face insert (72) is then pressed or swaged into an opening in the front face (81) of the cast face cup (74) while at the same time the cast face cup (74) is coined. The striking face insert (72) is then welded to the face cup (74) on the interior surface of the face component (60). The assembled face component (60) is then attached to the aft-body (61).

20 Claims, 7 Drawing Sheets

U.S. PATENT DOCUMENTS 5,346,217 A 9/1994 Tsuchiya et al.
5,377,986 A 1/1995 Viollaz et al.
5,398,935 A 3/1995 Katayamo
5,410,798 A 5/1995 Lo
5,425,538 A 6/1995 Vincent et al.
5,460,371 A 10/1995 Takeda
5,464,210 A 11/1995 Davis et al.
5,464,216 A 11/1995 Hoshi et al.
5,474,296 A 12/1995 Schmidt et al.
5,485,998 A 1/1996 Kobayashi
5,499,814 A 3/1996 Lu
5,501,459 A 3/1996 Endo
5,516,107 A 5/1996 Okumoto et al.
5,527,034 A 6/1996 Ashcroft et al.
5,547,427 A 8/1996 Rigal et al.
5,556,097 A 9/1996 Endo et al.
5,570,886 A 11/1996 Rigal et al.
5,624,331 A 4/1997 Lo et al.
5,743,813 A 4/1998 Chen et al.
5,776,011 A 7/1998 Su et al.
5,788,584 A 8/1998 Parente et al.
5,797,807 A 8/1998 Moore
5,830,084 A 11/1998 Kosmatka
5,863,261 A 1/1999 Eggiman
5,888,148 A 3/1999 Allen
6,048,278 A 4/2000 Meyer et al.
6,089,070 A 7/2000 Hancock et al.
6,145,365 A 11/2000 Miyaha
6,146,571 A 11/2000 Vincent et al.
6,149,534 A 11/2000 Peters et al.
6,152,833 A 11/2000 Werner et al.
6,165,081 A 12/2000 Chou
6,183,570 B1 2/2001 Kawaguchi et al.
6,193,614 B1 2/2001 Sasamoto et al.
6,354,962 B1 3/2002 Galloway et al.
6,368,234 B1 4/2002 Galloway
6,386,990 B1 5/2002 Reyes et al.
6,398,666 B1 6/2002 Evans et al.
6,440,011 B1 8/2002 Hocknell et al.
6,491,592 B1 12/2002 Cackett et al.
6,607,623 B1 * 8/2003 Murphy et al. ..... 156/156
6,695,608 B1 * 2/2004 Murphy et al. ..... 425/398
2002/0187853 A1 12/2002 Beach et al.

* cited by examiner

METHOD FOR PROCESSING A GOLF CLUB HEAD WITH CUP SHAPED FACE COMPONENT

CROSS REFERENCE TO RELATED APPLICATIONS

Not Applicable

FEDERAL RESEARCH STATEMENT

[Not applicable]

BACKGROUND OF INVENTION

1. Field of the Invention

The present invention relates to a method for manufacturing the face component of a golf club head. More specifically, the present invention relates to a method for manufacturing a golf club head composed of a two-piece face component, including a cast return section and formed face insert.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses.

Certain existing golf club heads have a metallic cup-shaped face component that is joined to a composite or metal body. The face component, which includes a striking face and a rearwardly extending flange, is currently forged as a single piece. The process of forging the face component, however, has several limitations in terms of wall thicknesses that can be achieved around the flange. It is not possible to forge face components with a very thin (less than 0.050 inch thickness) flange or a transition region between the striking face and the flange. These design considerations lead to very short tool life in forging and thus increase the cost of making such face component shapes.

A face component with a thinner walled flange and transition region than current face component provides several advantages. First, the weight removed from the thinner face component may be strategically redistributed to other areas of the club head to enhance the playing characteristics of the golf club head. Second, the thinner wall in the transition region between the striking face and the flange allows for more deflection of the face, thereby improving it's coefficient of restitution. Although the prior art has disclosed many variations of multiple material club heads, the prior art has failed to provide a multiple material club head with a high coefficient of restitution at a lower production cost.

SUMMARY OF INVENTION

The present invention is a method for producing a golf club head with a two-piece face component and a thin walled return portion flange between the striking face and the aft-body. The face component includes a formed or forged striking face insert and a cast face cup. This face component's thin-walled flange allows for greater compliance of the striking face with a golf ball during impact. A more compliant striking face provides for lower energy loss and a higher coefficient of restitution. In addition, the reduced weight of this two-piece face component enables additional weight to be strategically distributed to other areas of the club head to further enhance the playing characteristics of the golf club.

One aspect of the present invention is a method for producing a two-piece face component for assembly with an aft-body of a golf club head. The method includes casting a face cup with a front face and a return portion and forming an opening in the front face. The method further includes forming a striking face insert separate from the cast face cup. The striking face insert may be forged or formed from a sheet metal. The striking face insert is pressed or swaged into the opening of the cast face cup while the face cup is formed to fit with the aft-body. The striking face insert is then secured to the face cup from the inside of the face component, such as by a plasma, laser, or e-beam welding process. The return portion of the face component preferably has a thin-walled flange with a thickness of no more than 0.060 inch.

Another aspect of the present invention is a method for producing a golf club head having a two-piece face component and an aft-body. The method includes casting a face cup of the face component from a titanium alloy material and forming an opening in the front face. The face cup includes a front face and a return portion. The method further includes forming a striking face insert, also composed of a titanium alloy material, separate from the face cup and inserting the striking face insert into the opening of the face cup. The strike face insert is pressed or swaged into the opening of the face cup while the face cup is simultaneously formed to a dimension complementary to the aft-body.

The exterior surface is then machined, such that the striking face insert and the front face of the face cup are flush. The striking face insert is further welded to the face cup on an interior surface of the face component. The assembled face component is then secured to the aft-body of the golf club head.

Having briefly described the present invention, the above and further objects, features and advantages thereof will be recognized by those skilled in the pertinent art form in the following detailed description of the invention when taken in conjunction with the accompanying drawings.

DETAILED DESCRIPTION

Figure 1:
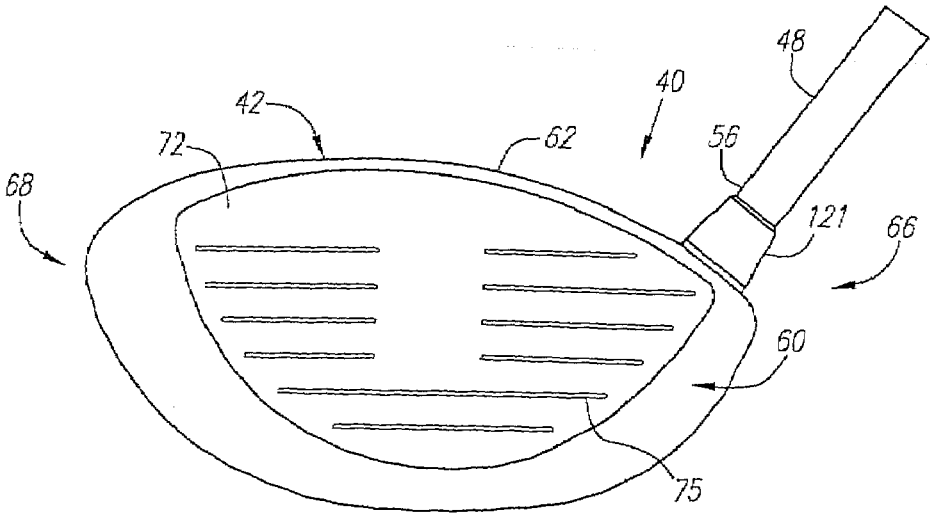
FIG. 1 is a front view of a golf club produced according to the method of the present invention.
Figure 1A:
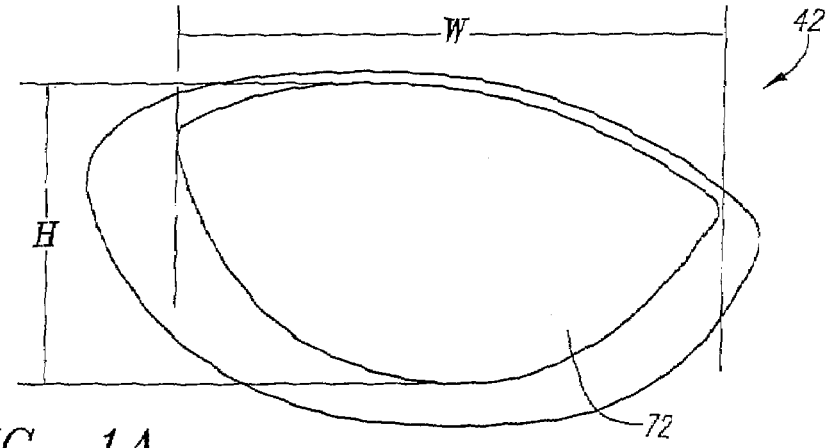
FIG. 1A is a front view of the golf club produced according to the method of the present invention showing the measurement for the aspect ratio.
Figure 2:
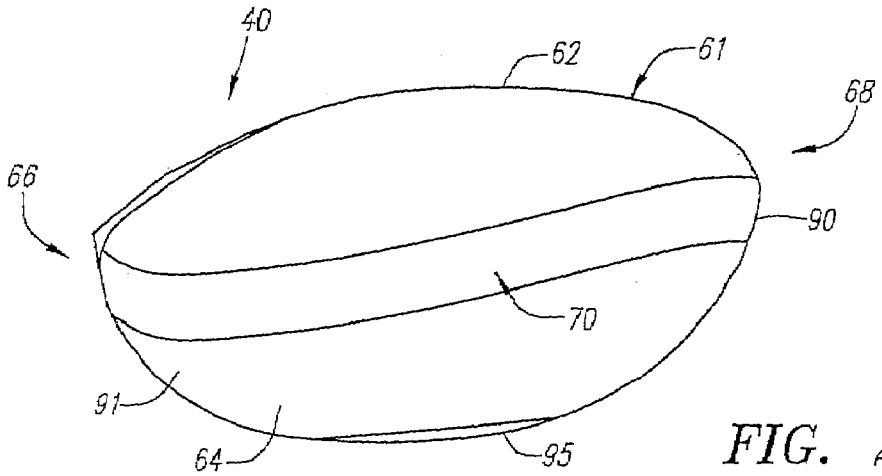
FIG. 2 is a rear view of the golf club head of FIG. 1.
Figure 3:
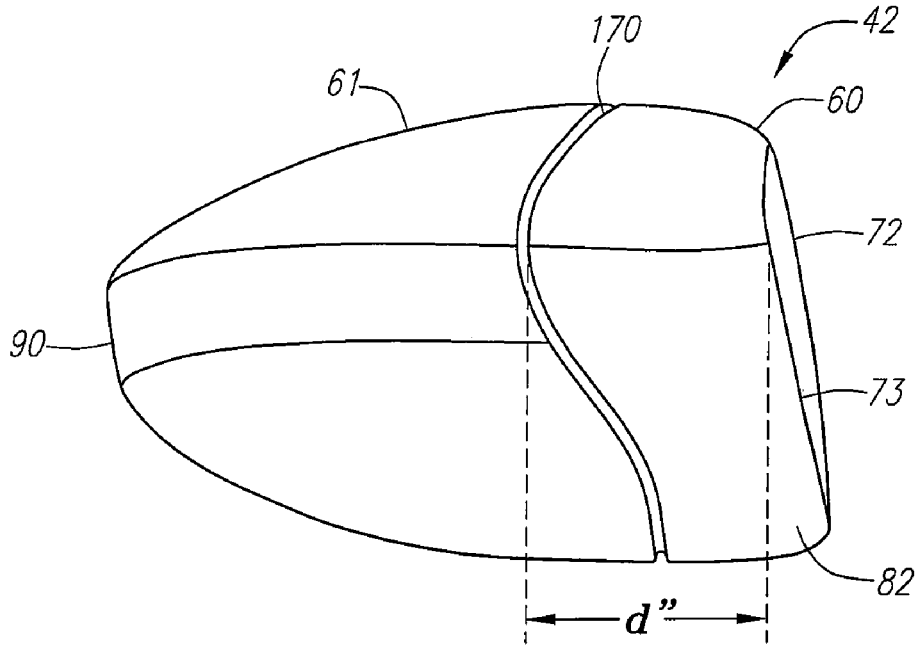
FIG. 3 is toe side view of the golf club head of FIG. 1.
Figure 4:
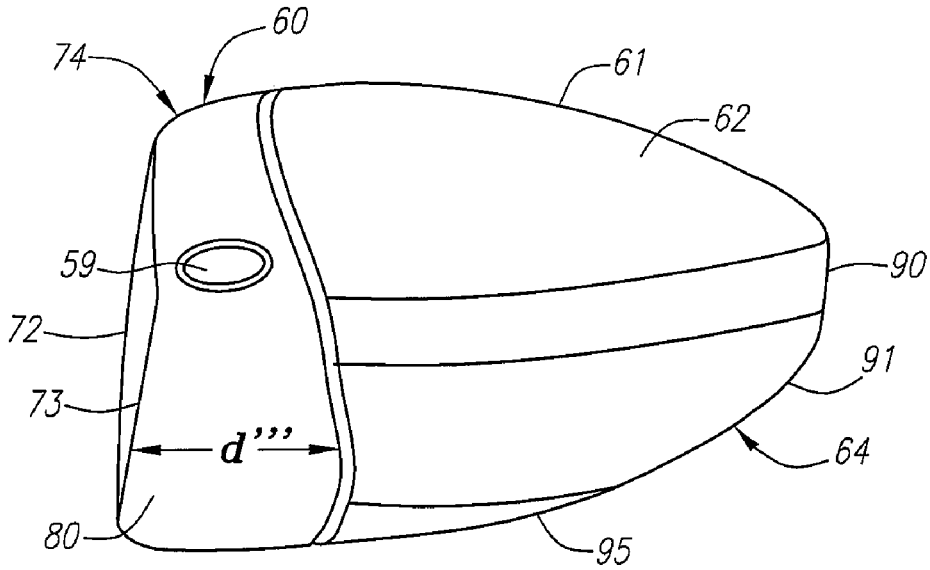
FIG. 4 is a heel side view of the golf club head of FIG. 1.
Figure 5:
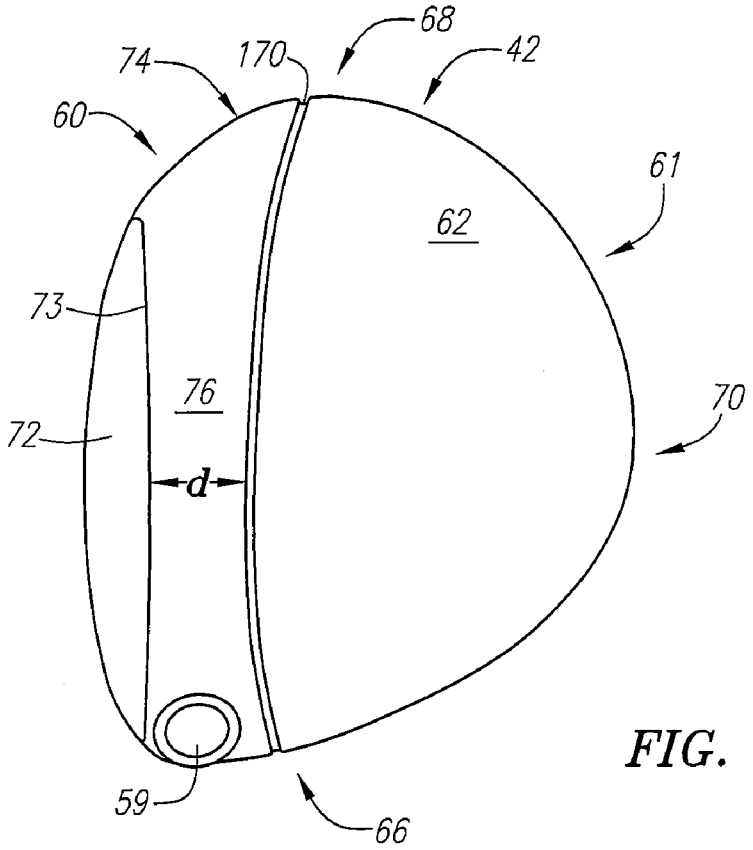
FIG. 5 is a top plan view of the golf club head of FIG. 1.
Figure 6:
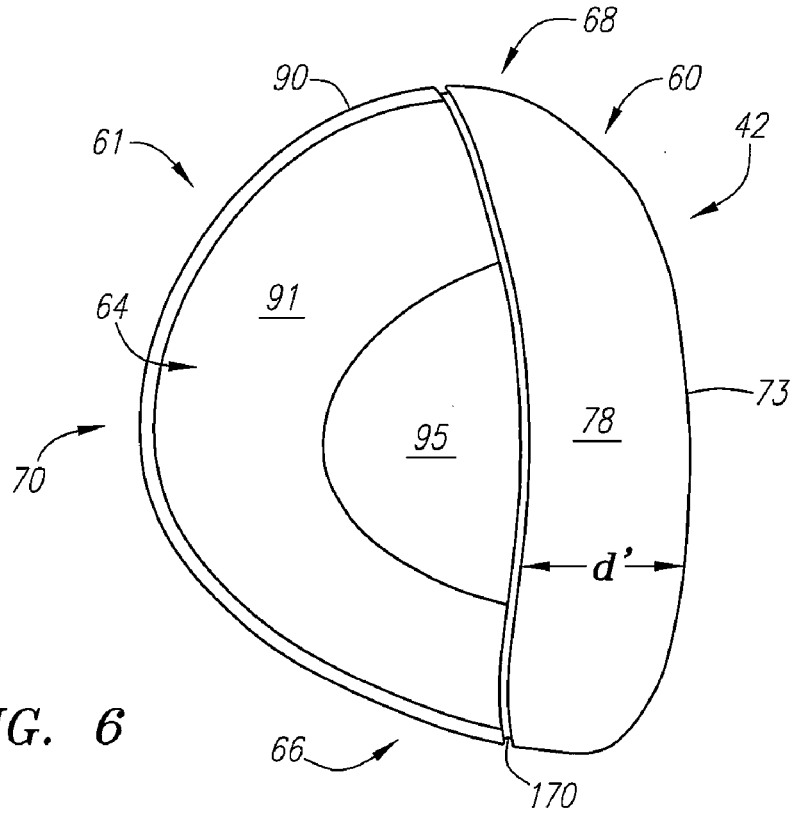
FIG. 6 is a bottom view of the golf club head of FIG. 1.

The present invention is directed at a method for producing a golf club head with a two-piece face component that includes a striking plate insert attached to a cast face cup. The cast face cup has a return portion with a thin-walled flange and transition zone, which allow for greater compliance of the striking face during impact with a golf ball. The compliant striking face provides the golf club head with a high coefficient of restitution thereby enabling a golf ball hit with the golf club head of the present invention to travel a greater distance. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution preferably ranging from 0.81 to 0.94, as measured under conventional test conditions.

The coefficient of restitution of the club head 42 of the present invention under standard USGA test conditions with a given ball preferably ranges from approximately 0.80 to 0.94, more preferably ranges from 0.82 to 0.883 and is most preferably 0.83.

As shown in FIGS. 1–7, a golf club is generally designated 40. The golf club 40 has a golf club head 42 with a hollow interior, not shown. Engaging the club head 42 is a shaft 48 that has a grip, not shown, at a butt end and is inserted into a hosel 54 at a tip end of the shaft 48.

The club head 42 is generally composed of two components, a face component 60, and an aft-body 61. The face component 60 has a striking plate insert 72 placed within an opening 45 of a face cup 74. The aft-body 61 has a crown portion 62 and a sole portion 64. The club head 42 may also be partitioned into a heel section 66 nearest the shaft 48, a toe section 68 opposite the heel section 66, and a rear section 70 opposite the face component 60.

The face component 60 is generally composed of two pieces of metal; the face cup 74 and the striking face insert 72. The opening 45, which is formed in a front face 81 of the face cup 74, is configured for placement of the striking face insert 72 therein. The face cup 74 has the return portion 77 extending laterally rearward from the perimeter of the front face 81.

Figure 7:
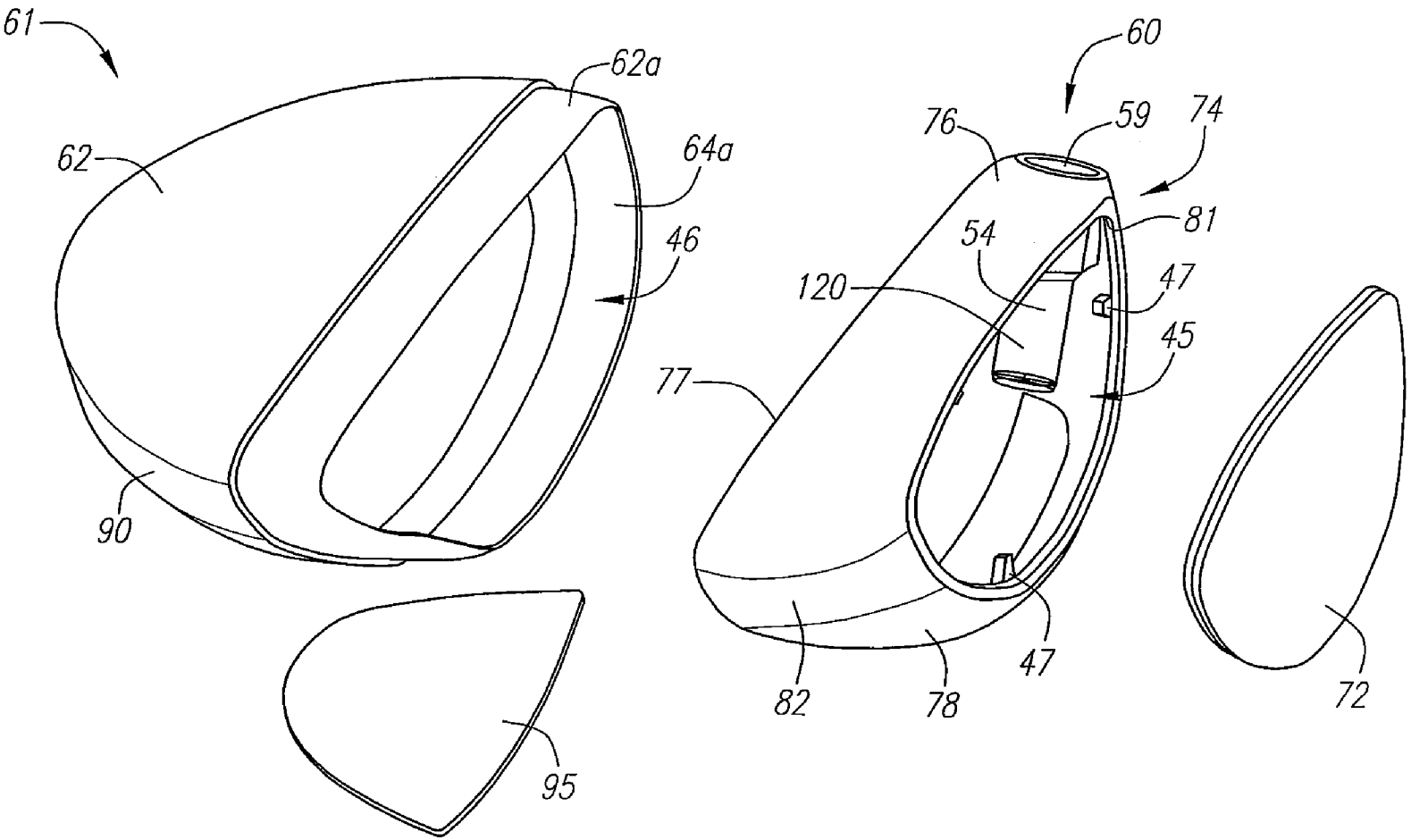
FIG. 7 is an exploded view of the golf club head produced according to the method of the present invention.

FIG. 7 is an exploded view of the golf club head 42 and shows the separate face cup 74 and striking face insert 72 pieces of the face component 60. The face cup 74 has a return portion 77 extending laterally rearward from the perimeter of the front face 81. As shown in FIG. 1, the striking face insert 72 typically has a plurality of score-lines 75 thereon. The striking face insert 72 is joined to the face 74 of the face component 60 in a manufacturing process discussed in more detail below.

In a preferred embodiment, the return portion 77 of the face cup generally includes an upper lateral section 76, a lower lateral section 78, a heel lateral section 80 and a toe lateral section 82. Thus, the return portion 77 preferably encircles the striking face insert 72 a full 360 degrees. However, those skilled in the pertinent art will recognize that the return portion 77 may only encompass a partial section of the striking face insert 72, such as 270 degrees or 180 degrees, and may also be discontinuous.

The upper lateral section 76 extends rearward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking face insert 72 to the rearward edge of the upper lateral section 76. In a preferred embodiment, the upper lateral section 76 has a general curvature from the heel section 66 to the toe section 68. The upper lateral section 76 has a length from the perimeter 73 of the striking face insert 72 that is preferably a minimal length near the center of the striking face insert 72, and increases toward the toe section 68 and the heel section 66. However, those skilled in the relevant art will recognize that the minimal length may be at the heel section 66 or the toe section 68.

The face component 60 engages the crown 62 along a substantially horizontal plane. The crown 62 has a crown undercut portion 62*a*, which is placed under the return portion 77. Such an engagement enhances the flexibility of the striking face insert 72 allowing for a greater coefficient of restitution. The crown 62 and the upper lateral section 76 are attached to each other as further explained below.

The heel lateral section 80 is substantially perpendicular to the striking face insert 72, and the heel lateral section 80 covers the hosel 54 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d'", from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole 64, both the ribbon 90 and the bottom section 91, as explained in greater detail below. The toe lateral section 82 extends inward a distance, d", from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a predetermined distance, d', to engage the sole 64. In a preferred embodiment, the predetermined distance ranges from 0.2 inch to 1.25 inches, more preferably 0.50 inch to 1.10 inch, and most preferably 0.9 inch, as measured from the perimeter 73 of the striking face insert 72 to the edge of the lower lateral section 78. In a preferred embodiment, the lower lateral section 78 has a general curvature from the heel section 66 to the toe section 68. The lower lateral section 78 has a length from the perimeter 73 of the striking plate section 72 that is preferably a minimal length near the center of the striking plate section 72, and increases toward the toe section 68 and the heel section 66.

The sole portion 64 has a sole undercut 64*a* for placement under the return portion 77. The sole 64 and the lower lateral section 78, the heel lateral section 80 and the toe lateral section 82 are attached to each other as explained in greater detail below.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. The aft-body 61 is preferably manufactured through bladder-molding, resin transfer molding, resin infusion, injection molding, compression molding, or a similar process. Alternatively, the aft-body may be composed of a metallic material such as magnesium, titanium, stainless steel, or any other steel or titanium alloy.

The crown portion 62 of the aft-body 61 is generally convex toward the sole portion 64, and engages the ribbon section 90 of sole portion 64 outside of the engagement with the face member 60. Those skilled in the pertinent art will recognize that the sole portion 64 may not have a ribbon section 90. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon section 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

Figure 8:
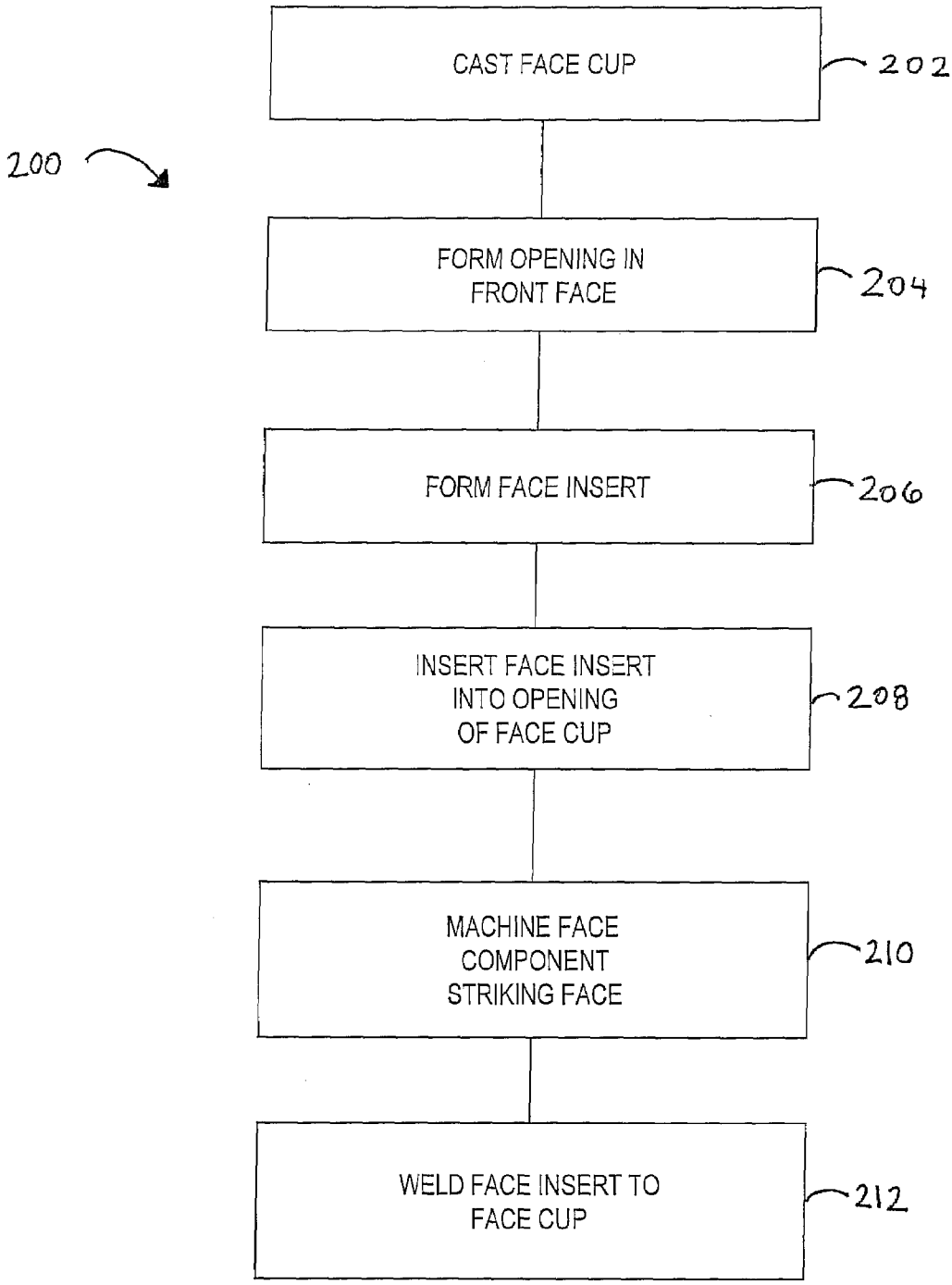
FIG. 8 is a flow chart of a method for producing a two-piece face component for the golf club head according to the present invention.

FIG. 8 is a flow chart of a method, generally designated 200, of manufacturing the face component 60. The method 200 commences at block 202 with the casting of the face cup 74. The face cup 74 may be composed of any of the previously mentioned materials, however, it is preferably composed of a titanium alloy, such as 6-4 titanium alloy, or a stainless steel. The face cup 74 may be cast with either a complete front 81 with the front face 84 having a hole formed therein. If the face cup 74 is cast with a hole in the front face, the hole is preferably smaller in size than the striking face insert 72.

At step 204 the opening 45 is formed in the front face 81. If the face cup 74 has been cast with a complete front face 81, then an opening substantially equal in size and shape to the striking face insert 72 is made in the front face 81 using either a laser or a water jet. Alternatively, if the face cup 74 has been cast with a hole in the front face 81, then the hole is machined to expand it to the dimensions of the striking face insert 72.

At step 206, the production of the striking face insert 72 commences. The striking face insert 72 is preferably composed of a titanium material. Such titanium materials include 6-4 titanium alloy, SP-700 titanium alloy, DAT 55G titanium alloy available from Diado Steel of Tokyo, Japan, Ti-10-2-3 Beta-C titanium alloy available from RTI International Metals of Ohio, Ti-15-3-3-3 alloy available from TIMET, and the like. Other metals for the striking plate include stainless steel and other high strength steel alloy metals.

The striking face insert 72 may be formed either from a metal sheet or from a forged bar. If the striking face insert 72 is formed from a metal sheet, the exact shape of the striking face insert 72 may be stamped from the metal sheet. Alternatively the shape of the striking face insert 72 maybe cut from the metal sheet using a laser or water jet. The stamped or cut shape is then hot formed to provide the striking face inert 72 with the proper bulge and roll angles required by the given loft. The temperature at which the striking face insert 72 is formed will preferably be chosen so as to not result in any alpha case on the material surface. Alternatively, if the striking face insert 72 is made from a forged metal bar, then the forged piece is trimmed to the exact shape of the striking face insert 72.

Figure 11:
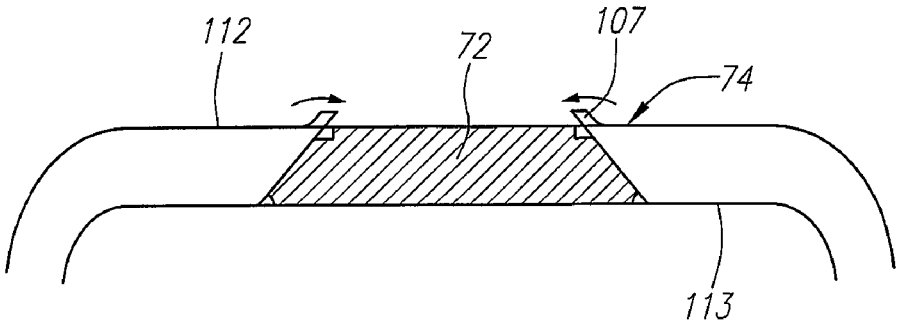
FIG. 11 is an isolated cross-sectional view of the face component, showing one arrangement of a striking face insert attached to a face cup.
Figure 12:
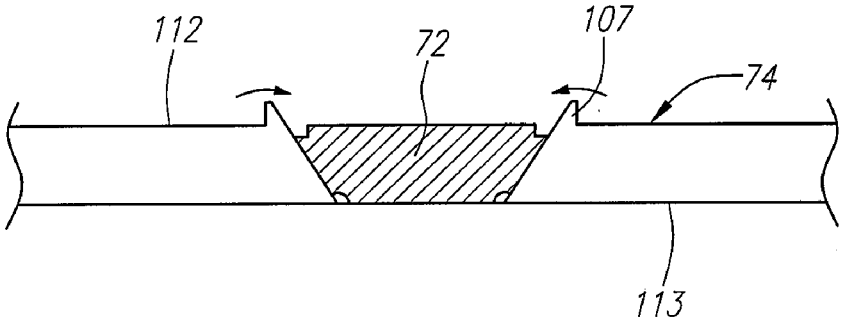
FIG. 12 is an isolated cross-sectional view of the face component, showing another arrangement of a striking face insert attached to a face cup.

At step 208 the striking face insert 72 is combined with the cast face up 74. The striking face insert is place in the opening 45 in the front face 81 of the face cup 74 and is pressed or swaged using one of the various methods known in the industry while the face cup 74 is simultaneously formed of coined to the dimensions of the aft-body 62. In the preferred embodiment as shown in FIG. 11, the striking face insert 73 is swaged from an interior surface 113 of the face component 60 and a face cup lip 107 is then folded over the striking face insert. Alternatively, as shown in FIG. 12, the striking face insert 72 may be swaged from an exterior surface 112 of the face component 60, while the face cup 74 is simultaneously coined. The face cup lip 107 is then folded over the striking face insert 72.

Figure 13:
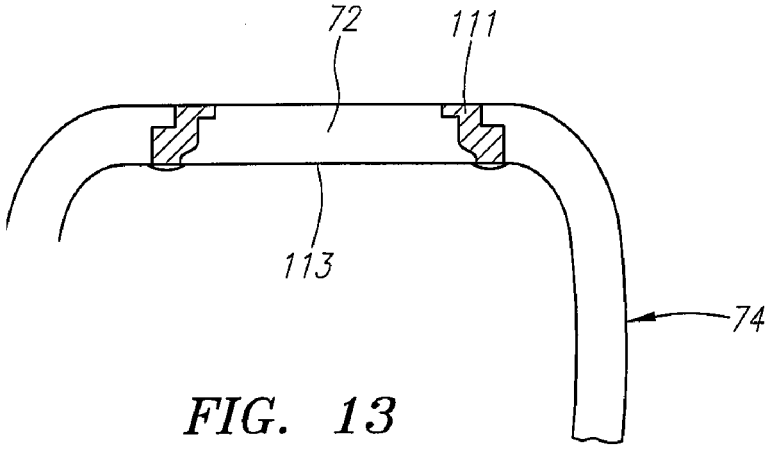
FIG. 13 is an isolated cross-sectional view of the face component, showing yet another arrangement of a striking face insert attached to a face cup via a retaining ring.

FIG. 13 illustrates yet another way of joining the striking face insert 72 and the face cup 74. A retaining ring 111 composed of a material such as copper or aluminum, is first placed around the striking face insert 72. The striking face insert 72 and retaining ring 111 are then inserted into the opening 45 of the face cup 74 and swaged while the face cup 74 is simultaneously coined to dimensions complementary to the aft body 61.

At step 210 the face component 60 face is machined such that the front face 81 of the face cup 74 and the striking face insert are flush. A plurality of scoreline groves 75 are formed on the exterior surface 112 of the face component 60.

At step 212 the striking face insert 72 is welded to the cast face cup 74 from the interior surface 113. The two pieces of the face component 60 are welded using a plasma, laser or e-beam welding process to produce an assembled face component 60. Plasma, laser and e-beam welding are preferred over standard TIG welding, since the weld beads are very small and the heat input is also small.

Figure 9:
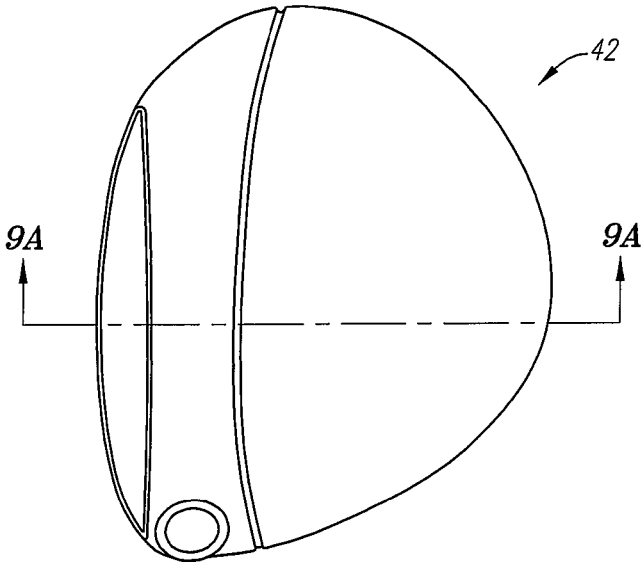
FIG. 9 is a top plan view of the golf club head of FIG. 1.
Figure 9A:
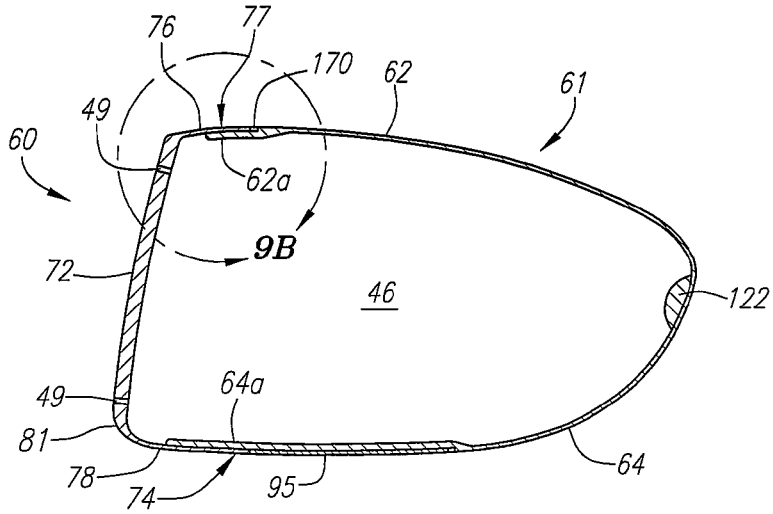
FIG. 9A is a cross-sectional view along line 9A—9A of FIG. 9.
Figure 9B:
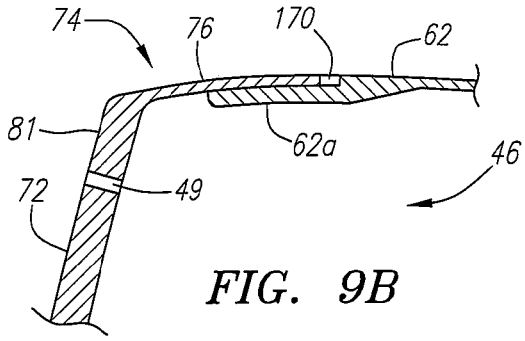
FIG. 9B is an isolated view of circle 9B of FIG. 9A.

The assembled face component 60 may then be attached to the aft body 60. In an attachment process shown in FIGS. 9, 9A, and 9B, the face component 60, with an adhesive on the interior surface of the return portion 77, is placed within a mold with a preform of the aft-body 61 for bladder molding. The return portion 77 is placed and fitted into the undercut portions 62*a* and 64*a*. Also, the adhesive may be placed on the undercut portions 62*a* and 64*a*. Such adhesives include thermosetting adhesives in a liquid or a film medium. During this attachment process, a bladder is placed within the hollow interior of the preform and face component 60, and is pressurized within the mold, which is also subject to heating. The co-molding process secures the aft-body 61 to the face component 60. In another attachment process, the aft-body 61 is first bladder molded and then is bonded to the face component 60 using an adhesive, or mechanically secured to the return portion 77.

Figure 10:
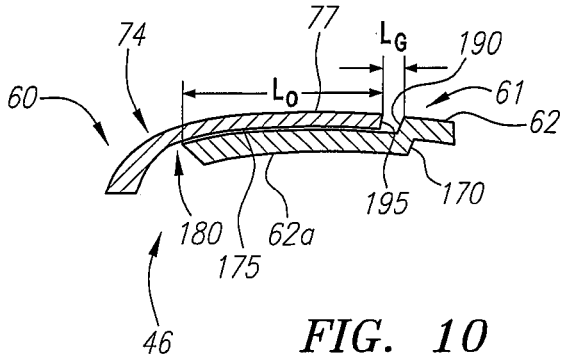
FIG. 10 is an isolated cross-sectional view of the face component overlapping the aft body.

As shown in FIG. 10, the return portion 77 overlaps the undercut portions 62*a* and 64*a* a distance Lo, which preferably ranges from 0.25 inch to 1.00 inch, more preferably ranges from 0.40 inch to 0.70 inch, and is most preferably 0.40 inch. An annular gap 170 is created between an edge 190 of the crown portion 62 and the sole portion 64, and an edge 195 of the return portion flange 77. The annular gap 170 has a distance, Lg, that preferably ranges from 0.020 inch to 0.100 inch, more preferably from 0.050 inch to 0.070 inch, and is most preferably 0.060 inch. A projection 175 from an upper surface of the undercut portions 62*a* and 64*a* establishes a minimum bond thickness between the interior surface of the return portion 77 and the upper surface of the undercut portions 62*a* and 64*a*. The bond thickness preferably ranges from 0.002 inch to 0.100 inch, more preferably ranges from 0.005 inch to 0.040 inch, and is most preferably 0.015 inch. A liquid adhesive preferably secures the aft body 61 to the face component 60. A leading edge 180 of the undercut portions 62*a* and 64*a* may be sealed to prevent the liquid adhesive from entering the hollow interior 46.

Because the face cup 74 of the face component 60 is cast, the thickness of the return portion flange 77 may be thinner than if the face cup 74 had been forged. The thickness of the return portion flange 77 is at most 0.060 inch, preferably with a maximum thickness of 0.050 inch.

The volume of the club head 42 produced in the present invention ranges from 250 cubic centimeters to 600 cubic centimeters, and more preferably ranges from 300 cubic centimeters to 510 cubic centimeters, even more preferably 345 cubic centimeters to 395 cubic centimeters, and most preferably 350 cubic centimeters. The volume of the golf club head 42 will also vary between fairway woods (preferably ranging from 3-woods to eleven woods) with smaller volumes and drivers, which will have larger volumes than the fairway woods.

The mass of the club head 42 produced in the present invention preferably ranges from 165 grams to 300 grams, more preferably ranges from 175 grams to 205 grams, and most preferably from 190 grams to 200 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting member 122 (preferably composed of three separate weighting members 122*a*, 122*b* and 122*c*) has a mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. The sole plate 95 preferably a mass preferably ranging from 3 grams to 20 grams, more preferably from 5 grams to 15 grams, and most preferably 8 grams. Additionally, epoxy, or other like flowable materials, in an amount ranging from 0.5 grams to 5 grams, may be injected into the hollow interior 46 of the golf club head 42 for selective weighting thereof.

The depth of the club head 42 from the striking plate insert 72 to the rear section of the crown portion 62 preferably ranges from 3.0 inches to 4.5 inches, and is most preferably 3.75 inches. The height, H, of the club head 42, as measured while in address position, preferably ranges from 2.0 inches to 3.5 inches, and is most preferably 2.50 inches or 2.9 inches. The width, W, of the club head 42 from the toe section 68 to the heel section 66 preferably ranges from 4.0 inches to 5.0 inches, and more preferably 4.7 inches.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for producing a two-piece face component for assembly with an aft-body of a golf club head, the face component having an interior surface as well as an exterior surface, the method comprising:

casting a face cup of the face component, the face cup including a front face and a return portion;

forming an opening in the front face of the face cup;

forming a striking face insert separate from the cast face cup;

inserting the striking face insert into the opening of the cast face cup simultaneously forming the face cup to the dimension complementary to the aft-body, and securing the striking face insert in the opening of the cast face cup to form an assembled face component, wherein the return portion of the assembled face component includes a thin walled flange with a thickness of no more than 0.060 inch.

2. The method according to claim 1 wherein the opening in the front face of the face cup is substantially equal in size to the striking face insert.

3. The method according to claim 1 wherein the opening in the front face is created using a laser.

4. The method according to claim 1 wherein the opening in the front face is created using a water jet.

5. The method according to claim 1 wherein casting the face cup includes casting the face cup such that the front face has a hole defined therein, the hole being smaller in size than the striking plate insert, and wherein forming the opening in the front face includes machining the hole until the opening is substantially equal in size to the striking face insert.

6. The method according to claim 1 further comprising placing a retaining ring around the striking face insert prior to inserting the striking face insert into the opening of the cast face cup.

7. The method according to claim 6 wherein the retaining ring is comprised of copper and aluminum.

8. The method according to claim 1 wherein forming the striking face insert includes forging the striking face insert and trimming the striking face insert to a desired shape.

9. The method according to claim 1 wherein the striking face insert is formed from a sheet of metal, and further comprising hot forming the striking face insert to provide a bulge angle and a roll angle.

10. The method according to claim 9 wherein the striking face insert is stamped from the sheet of metal.

11. The method according to claim 9 wherein the striking face insert is cut from the sheet of metal using a laser cutting process.

12. The method according to claim 9 wherein the striking face insert is cut from the sheet of metal using a water jet cutting process.

13. The method according to claim 1 wherein inserting the striking face insert into the opening of the cast face cup includes swaging the face insert into the opening of the cast face cup while simultaneously forming the face cup.

14. The method according to claim 1 further comprising machining the exterior surface of the face component such that the striking face insert is flush with the front face of the face cup.

15. The method according to claim 1 wherein securing the striking face insert into the opening of the cat face cup includes welding the striking face insert to the face cup, the welding occurring on the interior surface of the face component.

16. The method according to claim 15 wherein welding includes any one of laser welding, plasma welding, and e-beam welding.

17. A method for producing a golf club head including a two-piece face component and aft-body, the face component having an interior surface as well as an exterior surface, the method comprising:

casting a face cup of the face component from a titanium alloy material, the face cup including a front face and a return portion;

forming an opening in the front face of the face cup;

forming a striking face insert separate from the face cup, the striking face insert being composed of a titanium alloy material;

inserting the striking face insert into the opening of the cast face cup while simultaneously forming the face cup to a dimension complementary to the aft-body;

machining the exterior surface of the face component such that the striking face insert and the front face of the face cup are flush;

welding the striking face insert to the face cup, the welding occurring on the interior surface of the face component to form an assembled face component; and securing the assembled face component to the aft-body, wherein the return portion of the assembled face component includes a thin walled flange having a thickness of no more than 0.050 inch.

18. The method according to claim 17 wherein the striking face insert is formed from a sheet of titanium alloy material and further comprising hot forming the striking face insert to provide a bulge angle and a roll angle.

19. A method for producing a golf club head including a two-piece face component and an aft-body, the face component having an interior surface as well as an exterior surface, the method comprising:

casting a face cup of the face component from a titanium alloy material, the face cup including a front face and a return portion;

forming an opening in the front face of the face cup;

forging a striking face insert from a titanium alloy material;

swaging the forged striking face insert into the opening of the cast face cup while simultaneously forming the face cup to a dimension complementary to the aft-body;

machining the exterior surface of the face component such that the striking face insert and the front face of the face cup are flush;

welding the forged striking face insert to the face cup, the welding occurring on the interior surface of the face component to form an assembled face component; and securing the assembled face component to the aft-body, wherein the return portion of the assembled face component includes a thin walled flange having a thickness of no more than 0.050 inch.

20. The method according to claim 19 wherein casting the face cup includes casting the face cup such that the front face has a hole defined therein, the hole being smaller in size than the striking face insert, and wherein forming the opening in the front face includes machining the hole until the opening is substantially equal in size to the striking face insert.

* * * * *